US011351572B2

(12) United States Patent
Kruse et al.

(10) Patent No.: US 11,351,572 B2
(45) Date of Patent: Jun. 7, 2022

(54) SCREEN MAINTENANCE LINK

(71) Applicant: Terex USA, LLC, Westport, CT (US)

(72) Inventors: Jordan Clarence Kruse, Cedar Rapids, IA (US); Christopher Reed, Swisher, IA (US); Ryan Anthony Mumm, Newhall, IA (US)

(73) Assignee: Terex USA, LLC, Westport, CT (US)

( * ) Notice: Subject to any disclaimer, the term of this patent is extended or adjusted under 35 U.S.C. 154(b) by 309 days.

(21) Appl. No.: 16/202,872

(22) Filed: Nov. 28, 2018

(65) Prior Publication Data

US 2019/0160492 A1 May 30, 2019

Related U.S. Application Data

(60) Provisional application No. 62/592,035, filed on Nov. 29, 2017.

(51) Int. Cl.

| | |
|---|---|
| ***B07B 1/46*** | (2006.01) |
| ***B07B 1/28*** | (2006.01) |
| ***B07B 1/00*** | (2006.01) |
| ***B07B 13/18*** | (2006.01) |

(52) U.S. Cl.

CPC ..... *B07B 1/005* (2013.01); *B07B 1/46* (2013.01); *B07B 13/18* (2013.01); *B07B 1/28* (2013.01)

(58) Field of Classification Search

CPC .. B07B 1/005; B07B 1/28; B07B 1/46; B07B 13/18

USPC ..... 209/260

See application file for complete search history.

(56) References Cited

U.S. PATENT DOCUMENTS

2019/0160492 A1* 5/2019 Kruse ..... B07B 1/005

FOREIGN PATENT DOCUMENTS

| | | | | |
|---|---|---|---|---|
| CA | 2105232 C | * | 11/1996 | ..... B07B 1/005 |
| CA | 2785363 A1 | * | 2/2013 | ..... B02C 23/10 |
| CA | 3025838 A1 | * | 5/2019 | ..... B07B 1/005 |
| CN | 105579144 A | * | 5/2016 | ..... B02C 21/02 |
| DE | 3934295 A1 | * | 4/1991 | ..... B07B 1/36 |
| WO | WO-2019197706 A1 | * | 10/2019 | ..... B07B 1/005 |

* cited by examiner

*Primary Examiner* — Terrell H Matthews

(74) *Attorney, Agent, or Firm* — Simmons Perrine Moyer Bergman PLC

(57) ABSTRACT

Disclosed is an inclined mobile screen for processing road building materials which provides for easy reconfiguration of the screen from operation configuration to a transport configuration and to a maintenance configuration, which allows for increased clearance between the screen and a feed conveyor without requiring a hydraulic actuator disposed therebetween. Nested telescopic supports are selectively coupled together in an offset connection to allow changes in the orientation of the screen to result in changes in the separation between the screen and the conveyor so as to allow for more clearance therebetween during time of maintenance.

20 Claims, 5 Drawing Sheets

SCREEN MAINTENANCE LINK

CROSS REFERENCE TO RELATED APPLICATIONS

The present application claims the benefit of the filing date of provisional patent application having Ser. No. 62/592,035 filed on Nov. 29, 2017 by the same inventors, which application is incorporated herein in its entirety by this reference.

FIELD OF THE INVENTION

The present invention generally relates to mobile vibrating screens used in mining or road building material handling and processing.

BACKGROUND OF THE INVENTION

In the past, vibrating screen machines are normally made of a box-like structure and contain one or multiple layers of screen mesh to sort granular materials. The different sized openings in the mesh allow sizing of materials according to the size of these openings. The box structure usually contains at least one eccentric weighted shaft that shakes the box and its screen mesh to agitate and separate the granular materials fed into the top of the machine.

Vibrating screens must receive maintenance to continue in long term operation. One common type of maintenance is replacement of the screen wire. Many mobile screens can be operated in an inclined orientation but may need to be at or near a horizontal orientation for screen wire replacement to optimally occur. This substantially horizontal orientation of the screen is also often seen when the screen is in a transport configuration. However, this transport configuration also often has a feed conveyor cross tube support resting on a top flange of the sides of the screen. This configuration often leaves minimal access to the top screen deck for replacement of the screen wire.

Consequently, there is a need for an inexpensive and efficient way to provide ample clearance for replacement of the screen wire when the screen is in a horizontal configuration.

SUMMARY OF THE INVENTION

It is an object of the present invention to provide a mobile vibrating screen machine which can be configured for maintenance with a horizontal screen and an elevated feed conveyor to permit ample clearance for replacement of the screen wire, without a need for a hydraulic cylinder coupled between the screen and the feed conveyor.

It is a possible feature of the present invention to provide a selectively deployable mechanical link to hold the feed conveyor in an elevated position.

It is another possible feature of the present invention to provide a non-powered tube in tube feed conveyor support.

It is an advantage of the present invention to utilize only screen lifting actuators and system geometries of motion to move the feed conveyor into an elevated maintenance position, relative to the screen.

The present invention is an apparatus and method for screening material which is designed to satisfy the aforementioned needs, provide the previously stated objects, include the above-listed features, and achieve the already articulated advantages. For some maintenance operations, the present invention is carried out in an "extra hydraulic cylinder-less system" in a sense that the insufficient clearance between the screen wire and the feed conveyor support during maintenance has been eliminated without the need for any hydraulic cylinder between the screen and feed conveyor.

Accordingly, the present invention is a system and method for replacement of screen wire, while the screen is in a horizontal or transport orientation, which includes:

- a vibrating screen fixed to a screen base; which is pivotally coupled at one end to a base mainframe;
- an overhead feed conveyor configured to provide material to be screened to the vibrating screen at various operating angles;
- said overhead feed conveyor is coupled to screen base via screen base to conveyor tube-in-tube support legs which comprise outer tube and inner tube;
- a screen maintenance link which is selectively coupled through an offset connection between outer tube and inner tube, so that when said screen maintenance link is coupled to outer tube, and the vibrating screen is lowered, the combined length of screen base to conveyor tube-in-tube support legs is more than it would be if vibrating screen were lowered to a horizontal position without coupling screen maintenance link.

The present invention is also a system for screening material comprising:

- a vibrating screen, having a top portion and a bottom portion, said vibrating screen coupled to a screen base; which is pivotally coupled at one end to a base mainframe;
- means for inclining said vibrating screen with respect to said base mainframe;
- a feed conveyor configured to provide material to be screened to the vibrating screen;
- said feed conveyor is coupled to screen base via a variable length support;
- means for selectively changing a separation distance between said feed conveyor and said vibrating screen when said vibrating screen is in a predetermined configuration, without using any hydraulic or electric components other than those which are a part of said means for inclining said vibrating screen.

The present invention is also a method of replacing screen wire comprising the steps of:

- providing a vibrating screen which is pivotally coupled at one end to a base mainframe;
- providing a hydraulic system which controls forces to increase and decrease a pivot angle between said vibrating screen and said base mainframe;
- providing a conveyor configured to provide material to be screened to the vibrating screen;
- making a selection between a group of at least two configurations; wherein said group includes a first configuration which provides for a first clearance characteristic between said vibrating screen and said conveyor, and a second configuration which provides for a second clearance characteristic between said vibrating screen and said conveyor;
- lowering said vibrating screen from a starting orientation to later orientation;
- if a selection of said first configuration was made, then causing said first clearance characteristic to occur without using a source power other than that which is used to increase and decrease said pivot angle; and
- if a selection of said second configuration was made, then causing said second clearance characteristic to occur without using a source of power other than that which is used to increase and decrease said pivot angle.

BRIEF DESCRIPTION OF THE DRAWINGS

The invention may be more fully understood by reading the following description of the preferred embodiments of the invention, in conjunction with the appended drawings wherein:

FIG. 4 is a side view of the present invention with the screen elevated and the maintenance link connected.

FIG. 5 is a close up of a portion of FIG. 4.

DETAILED DESCRIPTION

Figure 1:
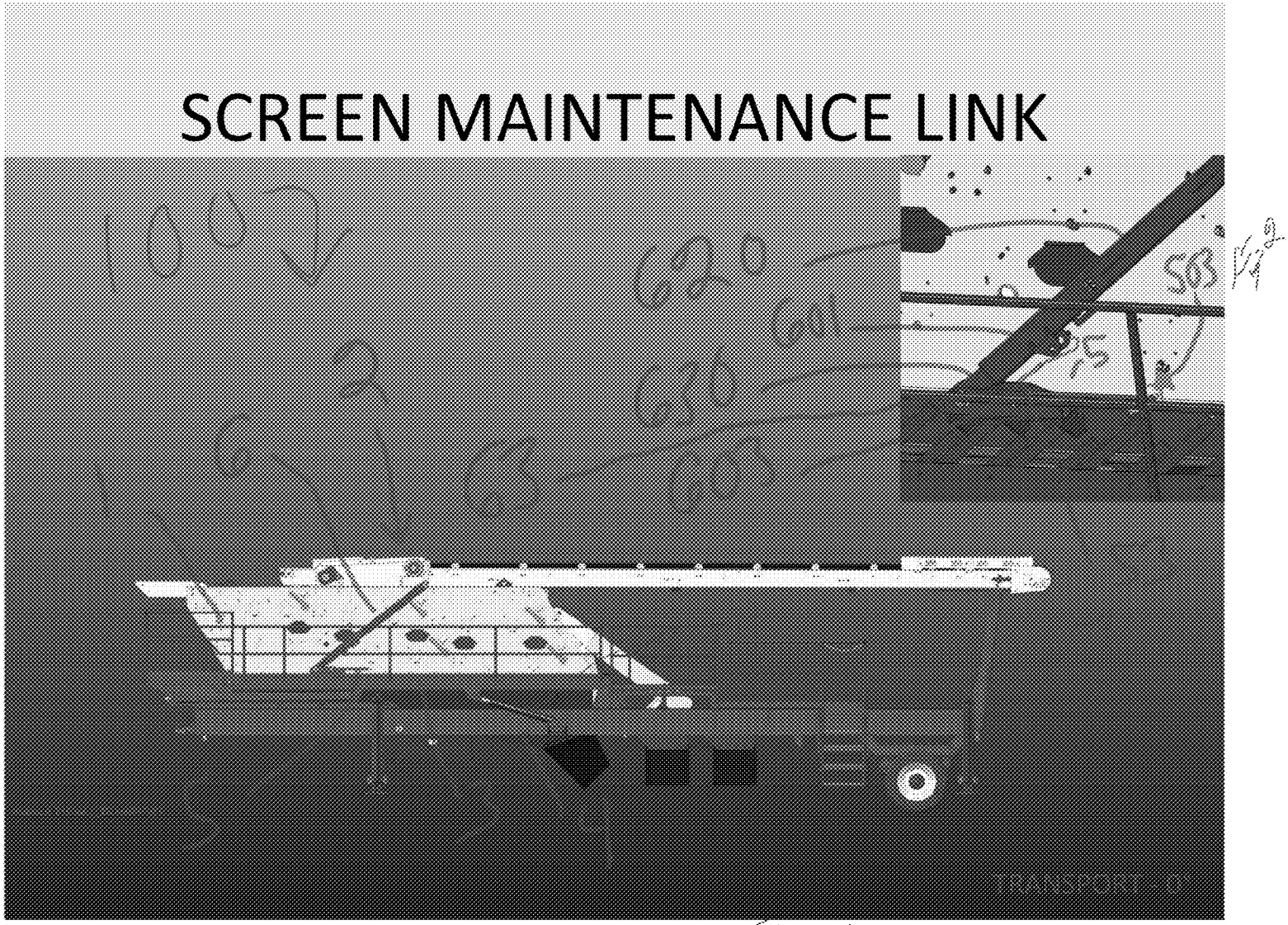
FIG. 1 is a side view of a vibrating screen of the present invention, shown in a transport configuration.

Now referring to the drawings wherein like numerals refer to like matter throughout, and more particularly to FIG. 1, there is shown a vibrating screen system 100 of the present invention, shown in a transport configuration with vibrating screen 1, overhead feed conveyor 2, screen base 3, and base mainframe 4, each in a horizontal orientation, and with overhead feed conveyor 2 being disposed directly on top of vibrating screen 1. Screen base to conveyor tube-in-tube support legs 6 are shown in an orientation which is not necessarily providing support to overhead feed conveyor 2. Screen maintenance link 5 is shown detached from screen base to conveyor tube-in-tube support legs 6 and in a horizontal orientation. Base mainframe to screen base hydraulic actuator 41 is shown in a retracted configuration which is not necessarily providing support to screen base 3. Base mainframe to conveyor support 7 is shown as being pivotally coupled to overhead feed conveyor 2 and fixed to base mainframe 4, however in some embodiments the fixed connection could also be made to pivot.

Figure 2:
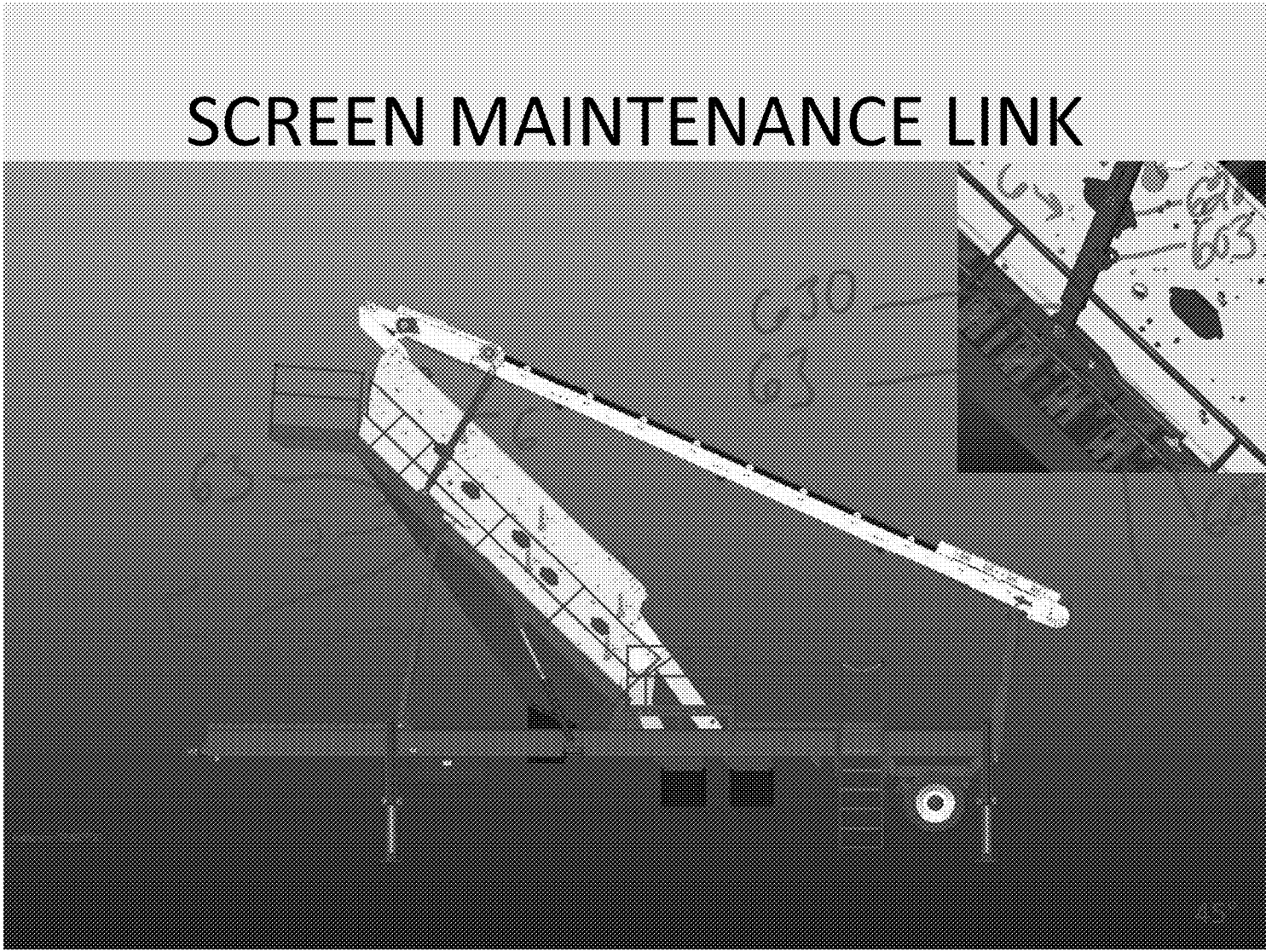
FIG. 2 is close up of a portion of FIG. 1.

Now referring to FIG. 2, there is shown a close up view of a portion of the vibrating screen system 100 of FIG. 1. Screen base to conveyor tube-in-tube support legs 6 are shown to be inner tube 630 and outer tube 620, which is shown having outside pin receiving void 601 and inside pin receiving void 603. Screen maintenance link 5 is clearly not coupled to outer tube 620 and removable maintenance link pin end 503 is pivoted about link to screen base offset pivotal connection 53 to be substantially horizontal.

Figure 3:
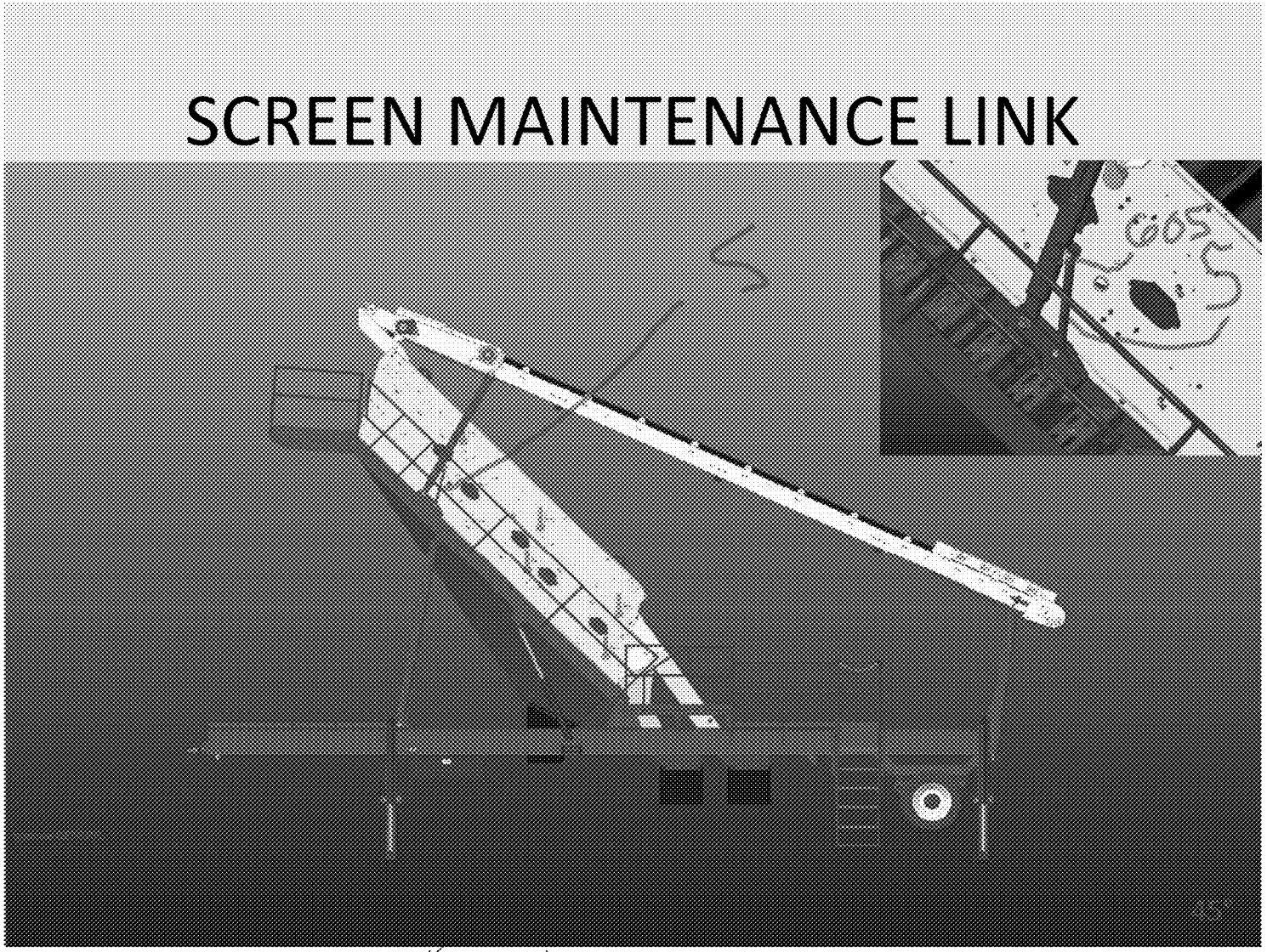
FIG. 3 is a side view of the present invention, with the screen elevated.

Now referring to FIG. 3, there is shown a view of the mobile vibrating screen system 100 with the screen in an operating inclination of about 45 degrees. Clearly, base mainframe to screen base hydraulic actuator 41 is extended and providing support. Screen maintenance link 5 remains disconnected from screen base to conveyor tube-in-tube support legs 6, which are now pivoted more than 90 degrees with respect to the screen base 3.

Now referring to FIG. 4, there is shown a configuration identical to FIG. 3 except that screen maintenance link 5 is coupled to screen base to conveyor tube-in-tube support legs 6. With the screen maintenance link 5 connected, the screen base to conveyor tube-in-tube support legs 6 are connected to each other through an offset connection, which forces the outer tube 620 and inner tube 630 to expand away from each other as geometry of the linkage changes during the process of lowering the vibrating screen 1 to a lower position for maintenance, but with more clearance between the vibrating screen 1 and the overhead feed conveyor 2.

Now referring to FIG. 5, there is shown a close up view of the screen maintenance link 5 portion of FIG. 4, which shows removable maintenance link pin 605 inserted and thereby coupling screen maintenance link 5 to outside pin receiving void 601 and inside pin receiving void 603.

Figure 6:
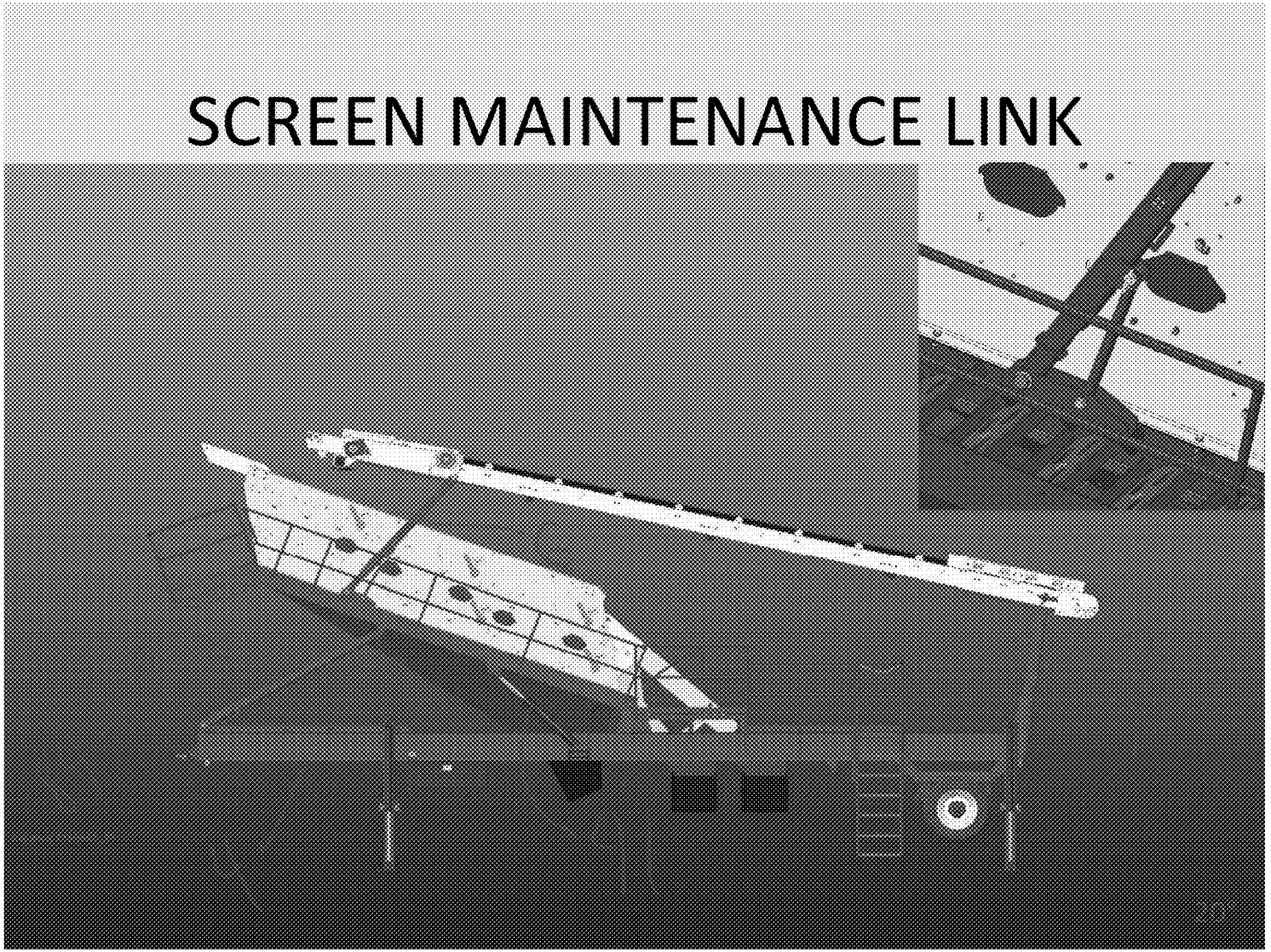
FIG. 6 is a side view of the present invention after the screen has been lowered to an intermediate elevation.

Now referring to FIG. 6, there is shown a view of the mobile vibrating screen system 100 with the vibrating screen 1 oriented at about 20 degrees. Base mainframe to screen base support 8 is shown being pivoted about both screen side pivot end 83 and mainframe side pivot end 84 to facilitate the lowering of the vibrating screen 1 closer to base mainframe 4.

Figure 7:
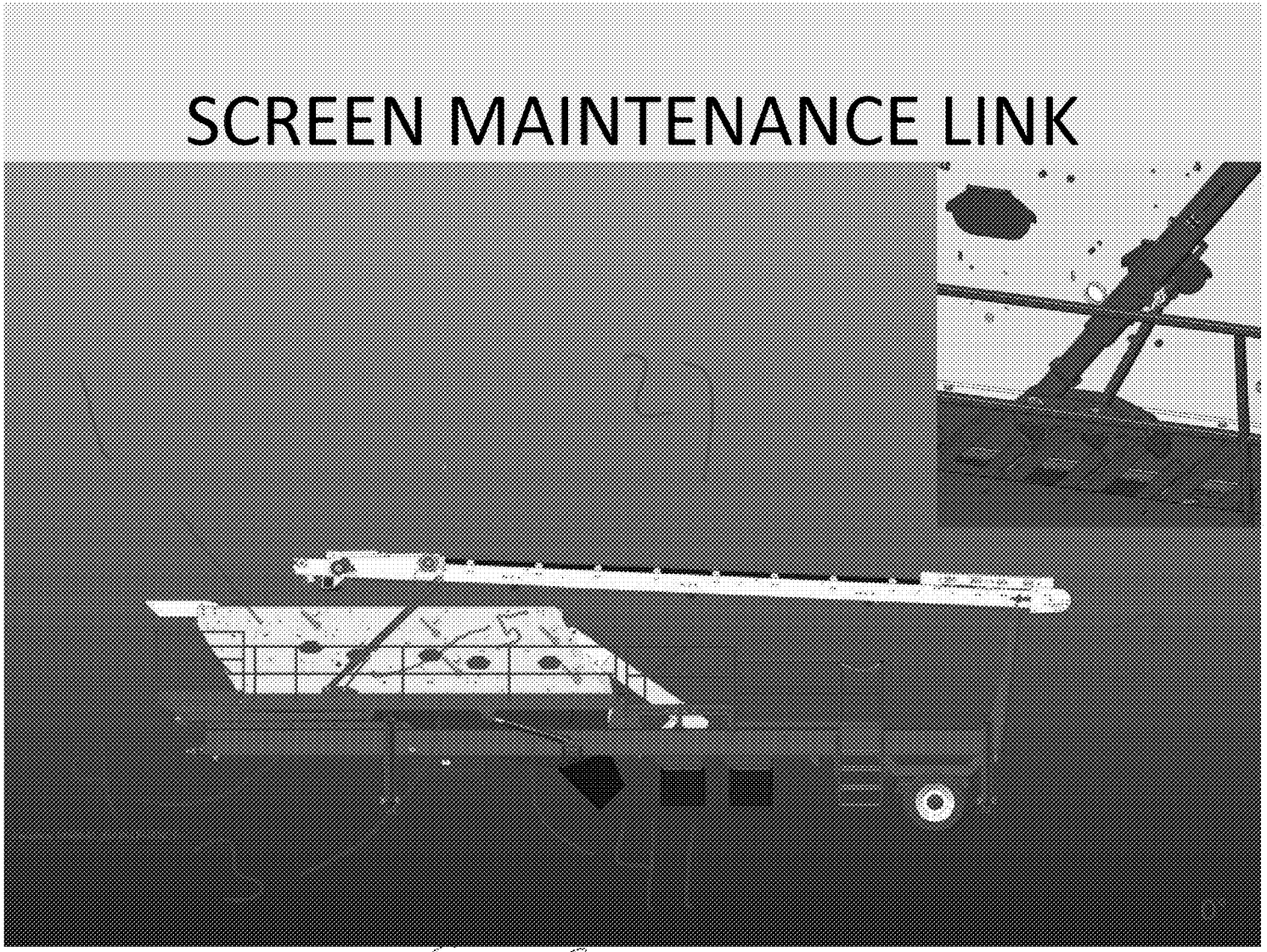
FIG. 7 is a side view of the present invention with the screen at a horizontal orientation and the feed conveyor elevated therefrom with the maintenance link coupled.

Now referring to FIG. 7, there is shown special orientation of the mobile vibrating screen system 100 where the vibrating screen 1 is horizontal and the overhead feed conveyor 2 is not resting on vibrating screen 1 because of the connection of screen maintenance link 5 and retraction of base mainframe to screen base hydraulic actuator 41. This configuration allows for a maintenance configuration without a need to add a dedicated linear actuator to increase the separation between vibrating screen 1 and overhead feed conveyor 2.

In operation, the present invention can function as follows:

A selection is made as to whether maintenance is to be done or the screen is to be put in transport mode, The selection results in the conveyor ending up with more clearance above the screen if the selection is for maintenance to be done and for less clearance if the screen is put into transport mode, As the screen is lowered closer to a horizontal orientation the conveyor is oriented with the selected clearance without the need to use any sources of power other than those used to incline the screen for operation.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

We claim:

1. A method of sorting material comprising the steps of:

providing a vibrating screen which is pivotally coupled at one end to a base mainframe;

providing a hydraulic system which controls forces to increase and decrease a pivot angle between said vibrating screen and said base mainframe;

providing a conveyor configured to provide material to be screened to the vibrating screen;

making a selection between a group of at least two configurations; wherein said group includes a first configuration which provides for a first clearance characteristic between said vibrating screen and said conveyor, and a second configuration which provides for a second clearance characteristic between said vibrating screen and said conveyor;

lowering said vibrating screen from a starting orientation to later orientation;

if a selection of said first configuration was made, then causing said first clearance characteristic to occur without using a source power other than that which is used to increase and decrease said pivot angle; and if a selection of said second configuration was made, then causing said second clearance characteristic to occur without using a source of power other than that which is used to increase and decrease said pivot angle.

2. The method of claim 1 further comprising the steps of: providing a means for providing a length adjustable support between said vibrating screen and said conveyor.

3. A method of claim 2 wherein said means for providing a length adjustable support comprises a plurality of parallel supports configured to translate with respect to each other.

4. The method of claim 3 wherein said means for providing a length adjustable support further comprises a screen maintenance link.

5. The method of claim 4 wherein said screen maintenance link is coupled through an offset connection to each of said plurality of parallel supports.

6. The method of claim 5 wherein said screen maintenance link has pivotable connections at two ends.

7. The method of claim 6 wherein said step of making a selection comprises one of: 1) inserting a removable maintenance link pin into a removable maintenance link pin end of said screen maintenance link, and 2) removing a removable maintenance link pin from a removable maintenance link pin end of said screen maintenance link.

8. The method of claim 7 further comprising the steps of: pivoting said screen maintenance link to a horizontal orientation if said removable maintenance link pin is removed.

9. A method for sorting material comprising the steps of:

providing a vibrating screen fixed to a screen base which screen base is pivotally coupled at one end to a base mainframe;

providing an overhead feed conveyor configured to provide material to be screened to the vibrating screen at various operating angles;

wherein said overhead feed conveyor is coupled to screen base via screen base to conveyor tube-in-tube support legs which comprise outer tube and inner tube;

providing a screen maintenance link which is selectively coupled, through an offset connection, between outer tube and inner tube, so that when said screen maintenance link is coupled to outer tube, and the vibrating screen is lowered, a combined length of screen base to conveyor tube-in-tube support legs is more than it would be if vibrating screen were lowered to a horizontal position without coupling screen maintenance link; and, using said vibrating screen to sort material.

10. The method of claim 9 further comprising the steps of: providing a source of hydraulic power disposed between and configured to cause relative motion between said screen base and said base mainframe.

11. The method of claim 10 wherein said screen is free of any hydraulic and electric components which provide power to cause relative motion between said screen base and said overhead feed conveyor, other than said source of hydraulic power disposed between and configured to cause relative motion between said screen base and said base mainframe.

12. The method of claim 11 further comprising the steps of providing a removable maintenance link pin used for coupling said screen maintenance link to said outer tube.

13. The method of claim 12 wherein an output end of said overhead feed conveyor is detachably coupled to said screen base.

14. The method of claim 12 wherein said overhead feed conveyor is detachable through translation of a protuberance along and open ended slot.

15. The method of claim 11 wherein said base mainframe to conveyor support is rigidly coupled to said base mainframe.

16. A method for sorting material comprising the steps of:

providing a vibrating screen, having a top portion and a bottom portion, said vibrating screen coupled to a screen base; which is pivotally coupled at one end to a base mainframe;

inclining said vibrating screen with respect to said base mainframe;

providing a feed conveyor configured to provide material to be screened to the vibrating screen;

wherein said feed conveyor is coupled to screen base via a variable length support; and selectively changing a separation distance between said feed conveyor and said vibrating screen when said vibrating screen is in a predetermined configuration, without using any hydraulic or electric components other than those which are a part of said means for inclining said vibrating screen.

17. The method of claim 16 wherein said step of selectively changing a separation distance is performed with a screen maintenance link.

18. The method of claim 17 wherein said step of inclining said vibrating screen uses a base mainframe to screen base hydraulic actuator.

19. The method of claim 18 wherein said step of selectively changing a separation distance; further comprises utilizing said screen maintenance link and creating an offset connection between nested members.

20. The method of claim 19 wherein said screen maintenance link is configured to be pivotable at two ends.

* * * * *